US007299512B2

(12) United States Patent
Cavalier et al.

(10) Patent No.: US 7,299,512 B2
(45) Date of Patent: Nov. 27, 2007

(54) MOTORIZED OPERATING TABLE

(75) Inventors: Patrice Cavalier, Saint Ay (FR); Philippe Daury, Boulogne (FR); Pierre Mercier, Neuvy en Sullias (FR); Bertrand Plouviez, Saint Jean de Brayc (FR); Jean-Marie Poussot, Saint Jean le Blanc (FR)

(73) Assignee: FHSurgical (FR)

( * ) Notice: Subject to any disclaimer, the term of this patent is extended or adjusted under 35 U.S.C. 154(b) by 53 days.

(21) Appl. No.: 10/987,235

(22) Filed: Nov. 12, 2004

(65) Prior Publication Data

US 2005/0125896 A1 Jun. 16, 2005

(30) Foreign Application Priority Data

Nov. 14, 2003 (FR) ..... 03 13377

(51) Int. Cl.
*A61G 13/10* (2006.01)

(52) U.S. Cl. ..... 5/600; 613/658

(58) Field of Classification Search ..... 5/658, 5/510, 662, 663, 503.1, 600, 616
See application file for complete search history.

(56) References Cited

U.S. PATENT DOCUMENTS 3,982,741 A * 9/1976 Mitchell et al. ..... 5/614
4,061,324 A * 12/1977 Kvaerna et al. ..... 5/600
4,589,126 A * 5/1986 Augustsson et al. ..... 378/209
5,369,825 A * 12/1994 Reesby ..... 5/613
6,351,678 B1 * 2/2002 Borders ..... 700/83
6,462,500 B1 * 10/2002 L'Hegarat et al. ..... 318/649
6,642,836 B1 * 11/2003 Wang et al. ..... 340/3.54
6,739,006 B2 * 5/2004 Borders et al. ..... 5/622
6,843,182 B2 * 1/2005 Torcheboeuf ..... 108/143

FOREIGN PATENT DOCUMENTS

| | | |
|---|---|---|
| DE | 2 260 140 A | 6/1974 |
| EP | 0 625 348 A1 | 11/1994 |
| EP | 0 917 868 A1 | 5/1999 |
| EP | 0 923 922 A2 | 6/1999 |
| EP | 1 312 332 A1 | 5/2003 |

* cited by examiner

*Primary Examiner*—Michael Trettel
(74) *Attorney, Agent, or Firm*—DLA Piper US LLP

(57) ABSTRACT

The present invention pertains to a motorized operating table (1) of the type comprising a horizontal platform (2) for supporting a patient, equipped at least in part with a side rail (3) for accessories, said platform (2) being affixed on a chassis mounted on wheels, characterized in that said table (1) comprises a control unit (7) for controlling the displacement of the operating table (1) attached on the side rail (3) and coupled to a base comprising a motor unit (8), said control unit (7) comprising control means for actuating the operating or the stopping of said motor unit.

15 Claims, 2 Drawing Sheets

MOTORIZED OPERATING TABLE

RELATED APPLICATION

This application claims priority of French Patent Application No. 03/13377. filed Nov. 14, 2003, hereby incorporated by reference.

FIELD OF THE INVENTION

The invention pertains to a motorized operating table of the type comprising a horizontal platform for supporting a patient equipped at least in part with a side rail for accessories, the platform being affixed to a chassis mounted on wheels. The operating table of the invention is preferably intended, but not exclusively, for surgical procedures.

BACKGROUND

During surgical operations, the patients are transferred from one site to another, more particularly from their room to the operating room where they will undergo the surgical procedure. Transfer of the patients is performed conventionally by means of transport gurneys which are displaced manually by the medical personnel. The patients are transferred from their bed to the transport gurney to be brought to the operating room where they are transferred from the transport gurney to the operating table. Such patient transfers are not easy to handle and represent risks of injuries for the medical personnel. Similarly, depending on the patient's status, such a transfer can also cause or aggravate the patient's injuries.

EP 0917868 discloses an operating table platform connected in a detachable manner to a chassis on wheels. The platform can advantageously be transferred successively from the mobile gurney to a column with fixed support, and vice versa. Although the transfer of the patient to the operating table is no longer performed by direct handling of the patient, the system nevertheless requires multiple personnel for moving the platform from one support to another. Such a system moreover has the drawback of being relatively difficult to operate.

Also known in the prior art are gurneys comprising a motorized base. Nevertheless, the systems that allow control of the motor are manual control systems. The handling of such gurneys remains relatively laborious for the medical personnel because they must guide the gurney with one hand and use the other hand for holding the control system.

WO 01/51910 there is discloses a radiotherapy treatment table configured to support and position a patient during treatment and mounted on a chassis comprising means forming columns mounted on a mobile chassis on wheels. The table comprises a positioning and direction device enabling detection of the position of the table in relation to a radiotherapy station and directing of the table so that it comes into a desired position at the level of the station, in response to the measurement of the actual position. Such a table nevertheless has limits in that its displacement is directly dependent on the treatment equipment. In order to be displaced, the treatment table must necessarily be positioned close to the radiotherapy station.

SUMMARY OF THE INVENTION

This invention relates to a motorized operating table including a horizontal platform for supporting a patient; a chassis mounted on wheels that supports at least a portion of the platform; at least one side rail for accessories connected to at least a portion of the platform: a control unit for controlling displacement of the operating table attached on the side rail and coupled to a base including a motor unit attached to the operating table, the control until including a controller to actuate operating or stopping of the motor unit.

This invention also relates to an accessory for the operating table including guide arms attached in a detachable manner on the side rail, the guide arms including a control unit to control displacement of the operating table.

This invention further relates to an operating system including a multiplicity of operating tables equipped with an accessory including guide arms attached in a detachable manner on the side rail, the guide arm including a control unit to control displacement of the operating table, the number of guide arms being lower than or equal to the number of operating tables.

BRIEF DESCRIPTION OF THE DRAWINGS

Better understanding of the invention will be obtained from the description below presented for purely explanatory purposes of one mode of implementation of the invention with reference to the attached figures.

DETAILED DESCRIPTION

Figure 1:
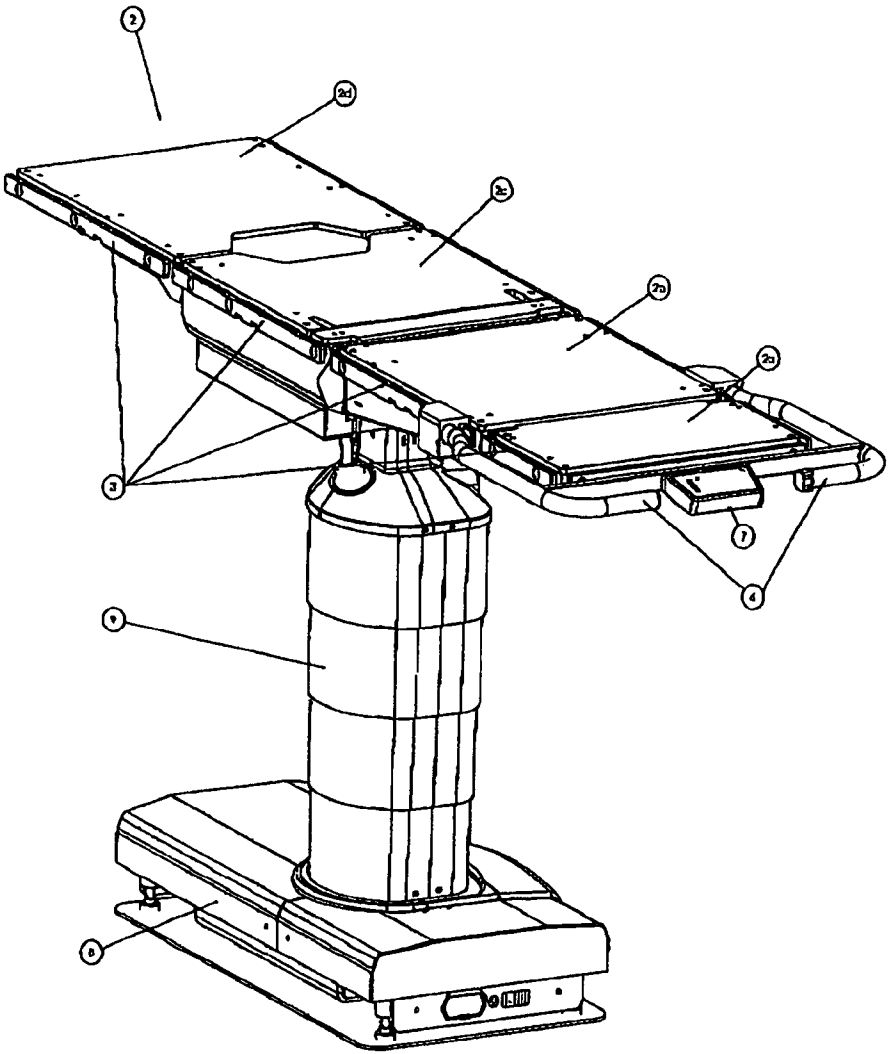
FIG. 1 illustrates a perspective view of an operating table according to the invention.

This invention is remarkable, in its broadest sense, in that the table comprises a control unit for controlling the displacement of the operating table, which unit is attached on the side rail and coupled to a base comprising a motor unit attached to the operating table, the control unit comprising control means for actuating the operating or shut-off of said motor unit. The control unit is preferably attached on the side rail in a detachable manner. The control unit advantageously constitutes guide arms of the operating table. The coupling of the control unit and the motor unit is advantageously implemented electrically or optically.

In a preferred aspect, the coupling of the control unit and the motor unit is implemented via infrared means, the motor unit comprising an infrared sensor. In such a configuration, the infrared emitted by the control unit are advantageously directive to present an emission zone limited to a surface surrounding the infrared sensor of the motor unit, the surface being inscribed in the upper surface of the base.

The control means advantageously transmit to the motor unit coded displacement orders that are not specific to the operating table. Thus, when the control unit is configured to be attached in a detachable manner on the side rail formed around the platform of the operating table, the control unit can be adjusted and operated with any other operating table equipped with a base comprising a motor unit with which the control unit can be coupled.

According to one aspect, the table furthermore comprises a detector of attachment of control unit on the operating table. The attachment detector has the function of deactivating the motor unit in the absence of attachment of the control unit on the operating table.

The motor unit is advantageously attached on the support of the operating table, preferably centrally in relation to the support. The motor unit advantageously controls at least one of the wheels of the operating table and preferably a wheel positioned centrally in relation to the support.

The invention also pertains to an accessory for motorized operating table comprising a horizontal platform for supporting a patient equipped at least in part with a side rail for accessories, the platform being affixed on a chassis mounted on wheels, the accessory consisting of guide arms of the operating table attached in a detachable manner on the side rail of the support. The guide arms comprise a control unit controlling the displacement of the operating table coupled to a base comprising a motor unit as well as control means for actuating the operating or shut-down of the motor unit.

The coupling of the control unit and the motor unit is implemented optically, preferably via infrared means. The infrared emitted by the control unit and received by an infrared sensor of the motor unit are directive and advantageously have a conical emission zone the intersection of which with the top surface of the base forms a detection surface comprising the infrared sensor of the motor unit.

The control means advantageously transmit to the motor unit coded displacement commands not specific to the operating table. Thus, as indicated above, it is thus possible to use the control unit on any operating table as long as it is equipped with the necessary equipment, i.e., a motor unit enabling coupling with the control unit the coupling being able to be implemented electrically or optically. Optical coupling is nevertheless preferred to facilitate the handling of the control unit.

The invention also pertains to an operating system comprising a multiplicity of operating tables as previously described, at least one of the operating tables being equipped with an accessory such as described above. The system is configured in such as manner that it advantageously comprises a number of guide arms smaller than or equal to the number of operating tables.

Turning now to the Drawings, FIG. 1 illustrates an operating table (1) intended notably for surgical procedures. The operating table (1) comprises a horizontal platform (2) intended to support a patient, which is affixed to a chassis (9) mounted on wheels.

The platform (2) is formed advantageously of four parts (2*a* to 2*d*) intended to receive respectively the patient's head, back, pelvis and legs. Moreover, the parts (2*a* to 2*d*) are connected to each other in a manner to allow the respective adjustment of the slope of each of the parts (2*a* to 2*d*).

Each part (2*a* to 2*d*) of the platform (2) is equipped with side rails (3). The parts (2*a* to 2*d*) advantageously constituting, respectively, the front and the back of the platform (2) are also equipped, respectively, on their front and rear surface with a side rail. The rails positioned in this manner on the side of the platform (2) makes it possible to attach accessories used by the surgeon during a surgical procedure. The rails are in particular intended for the attachment of surgical tools.

The operating table (1) moreover comprises guide arms (6) attached respectively to the side rails of the part (2*b*) of said platform (2). The guide arms (6) constitute a control unit (7) for controlling the displacement of the operating table (1). In order to achieve this, the control unit (7) is coupled to a base comprising a motor unit (8), the base constituting a part of the operating table (1). More particularly, the base positioned under the platform (2), constitutes a part of the chassis supporting said platform (2).

It should be noted that the term "displacement control" should be understood to mean the start-up of the motor, the turn-off of the motor and the control of the displacement speed of the operating table (1).

Similarly, the term "displacement of the operating table" (1) should be understood to mean the moving forward and moving backward of the operating table to move from one position to another. Thus, when the motor unit (8) is activated by means of the control unit (7), the operating table (1), according to the control operated via said control unit (7), will move forward or backward automatically. The turning off of the motor unit will lead to the stopping of the automatic displacement of the operating table (1). It is obviously understood that the turning off of the motor unit (8) will not prevent an intentional manual displacement of the operating table (1).

The coupling of said control unit (7) with the motor unit (8) is implemented electrically or optically. More precisely, the control unit (7) is coupled with a receiver intended to receive the electrical or optical signals emitted by the control unit (7), the receiver being itself linked to an active computer controlling the motor unit (8). In one preferred aspect, the coupling is implemented optically, advantageously by infrared means. For this purpose, the motor unit (8) comprises an infrared sensor (not shown).

In order to prevent any interaction with the operating tables that are also equipped with a motor unit equipped with an infrared sensor, the tables being located in the reception field of the infrared emitted by the control unit (7), the emission of the infrared is directive. More precisely, the emission zone is limited to a surface surrounding the infrared sensor of the motor unit (8), the surface being inscribed in the top surface of the base. Still more precisely, the emission zone is a conical zone the intersection of which with the top surface of the base forms the detection surface containing the infrared sensor.

Figure 2:
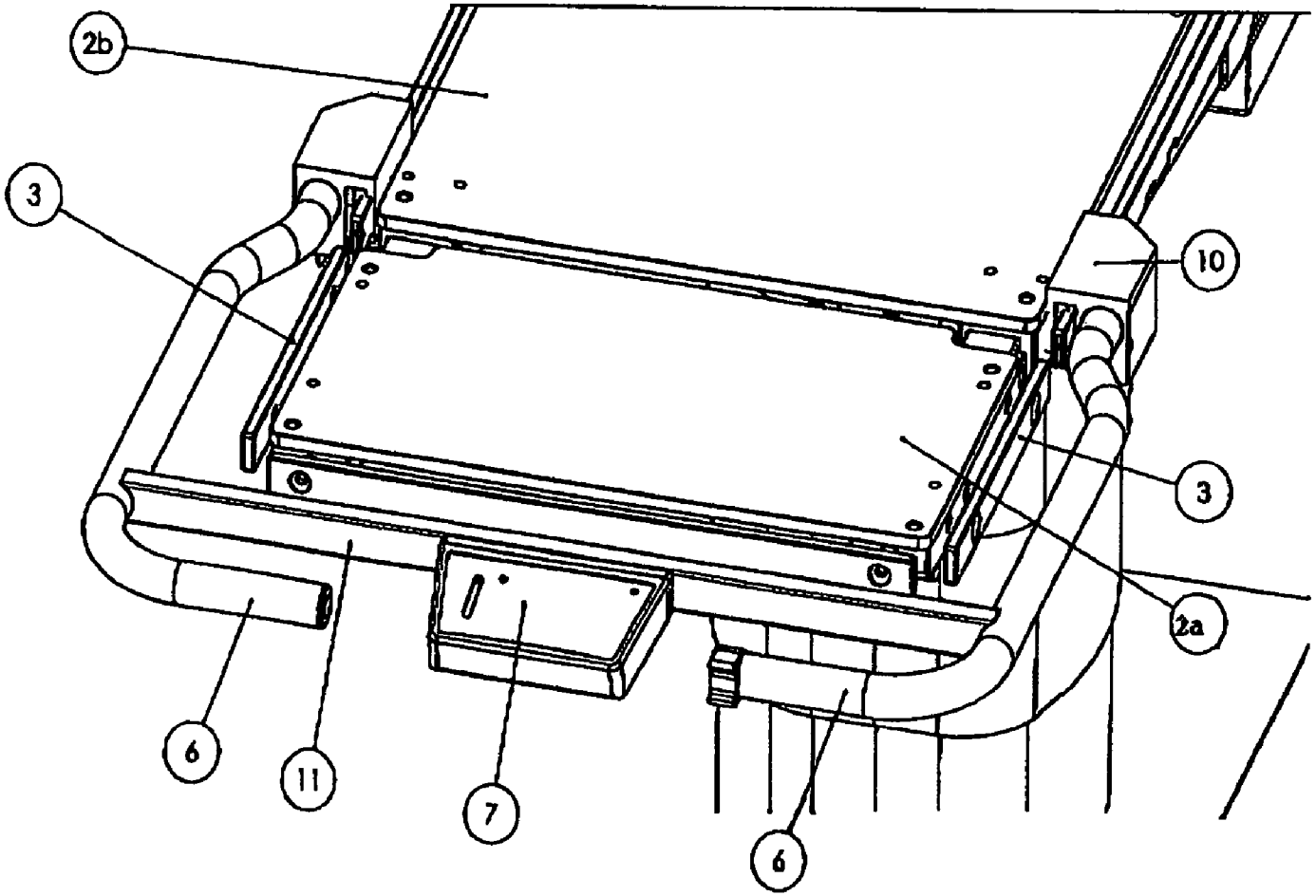
FIG. 2 illustrates an enlarged perspective view of the guide arms according to the invention.

FIG. 2 illustrates an enlarged view of the control unit of the guide arms (6) attached to the operating table (1) of FIG. 1.

The guide arms (6) are equipped respectively at one of their ends with an attachment element (10) intended to be attached on the rails as accessories surrounding the platform (2). The attachment elements (10) are advantageously affixed on the side rails (4) of the part (2*b*) of the platform (2). In this example, the attachment element (10) has a cavity configured to allow the attachment element to be clipped on the side rail (3).

The guide arms (6) have at their free ends a zone forming a handle. One of the handles is advantageously equipped at its end with a security button that can pivot along an axis identical to the longitudinal axis of the zone forming the handle. The security button enables activation of the displacement of the operating table (1) (move forward or move backward) and the controlling of its speed. In order to facilitate its handling, the security button has a shape essentially in the form of a thumb.

The guide arms are connected to each other by a cross bar (11) which supports the control unit (7) intended to control the displacement of the operating table (1).

The operating table advantageously comprises an attachment detector (not shown) of the control unit (7). Thus, in the absence of attachment of the control unit (7) on the side rails (3) of the platform (2), the attachment detector will deactivate the motor unit (9).

One of the principal advantages of the invention is to provide guide arms (6) that can be adapted to any operating table (1) equipped with a motor that can be coupled electrically or optically with the guide arms (6). It is therefore be advantageous if the commands emitted by the control unit (7) to said motor unit (8) consisted of coded displacement commands the coding of which is not specific to an operating table (1). Thus, in the case of a system comprising multiple operating tables (1), it is not necessary to necessarily provide as many guide arms (6) as there are operating tables (1).

The invention is described above as a non-limitative example. It is understood that one skilled in the art can implement different variants of the invention without going beyond the scope of the invention as defined in the appended claims.

The invention claimed is:

1. A motorized operating table comprising:

a horizontal platform for supporting a patient;

a chassis mounted on wheels that supports at least a portion of the platform;

at least one side rail for accessories connected to at least a portion of the platform; and a control unit for controlling displacement of the operating table attached on the side rail and coupled to a base comprising a motor unit attached to the operating table, the control unit comprising a controller to actuate operation or stopping of the motor unit and wherein the control unit comprises guide arms of the operating table.

2. The operating table according to claim 1, wherein the control unit is attached to the side rail in a detachable manner.

3. The operating table according to claim 1, wherein coupling of the control unit and the motor unit is implemented electrically or optically.

4. The operating table according to claim 1, wherein coupling of the control unit and the motor unit is implemented by infrared, the motor unit comprising an infrared sensor.

5. The operating table according to claim 4, wherein infrared emitted by the control unit is directional and has an emission zone limited to a surface surrounding the infrared sensor, the surface being inscribed in a top surface of the chassis.

6. The operating table according to claim 1, wherein commands emitted by the control unit to the motor unit are coded displacement commands not specific to the operating table.

7. A motorized operating table comprising:

a horizontal platform for supporting a patient;

a chassis mounted on wheels that supports at least a portion of the platform;

at least one side rail for accessories connected to at least a portion of the platform;

a control unit for controlling displacement of the operating table attached on the side rail and coupled to a base comprising a motor unit attached to the operating table, the control unit comprising a controller to actuate operation or stopping of the motor unit; and a detector of attachment of the control unit on said operating table, the attachment detector deactivating the motor unit in the absence of attachment of the control unit on the operating table.

8. The operating table according to claim 7, wherein the motor unit is positioned under the platform of the operating table.

9. The operating table according to claim 7, wherein the motor unit is positioned centrally in relation to the platform.

10. The operating table according to claim 7, wherein the motor unit is linked to at least one of the wheels of the operating table.

11. The operating table according to claim 7, wherein the motor unit is linked to a wheel positioned centrally in relation to the platform.

12. An accessory for a motorized operating table comprising a horizontal platform for supporting a patient; a chassis mounted on wheels that supports at least a portion of the platform; at least one side rail for accessories connected to at least a portion of the platform; and a control unit for controlling displacement of the operating table attached on the side rail coupled to a base comprising a motor unit attached to the operating table, the control unit comprising a controller to actuate operation or stopping of the motor unit, comprising:

guide arms attached in a detachable manner on the side rail, the guide arms comprising a control unit to control displacement of the operating table.

13. The accessory according to claim 12, wherein coupling of the control unit and the motor unit is implemented optically, by infrared means, and infrared emitted by the control unit and received by an infrared sensor of the motor unit is directional and has a conical emission zone, an intersection of which with a top surface of the chassis forms a detection surface comprising an infrared sensor of the motor unit.

14. The accessory according to claim 12, wherein commands emitted by the control unit to said motor unit are coded displacement commands not specific to the operating table.

15. An operating system comprising a multiplicity of operating tables, each operating table comprising:

a horizontal platform for supporting a patient;

a chassis mounted on wheels that supports at least a portion of the platform;

at least one side rail for accessories connected to at least a portion of the platform; and a control unit for controlling displacement of the operating table attached on the side rail and coupled to a base comprising a motor unit attached to the operating table, the control unit comprising a controller to actuate operation or stopping of the motor unit;

equipped with an accessory comprising guide arms attached in a detachable manner on the side rail, the guide arm comprising a control unit to control displacement of the operating table, the number of guide arms being lower than or equal to the number of operating tables.

* * * * *